US006227897B1

(12) United States Patent
D'Agostino

(10) Patent No.: US 6,227,897 B1
(45) Date of Patent: May 8, 2001

(54) SYSTEM FOR HIGH-BANDWIDTH ELECTRICAL COUPLING

(75) Inventor: Eric D. D'Agostino, Topsfield, MA (US)

(73) Assignee: Mercury Computer Systems, Inc., Chelmsford, MA (US)

( * ) Notice: Subject to any disclaimer, the term of this patent is extended or adjusted under 35 U.S.C. 154(b) by 0 days.

(21) Appl. No.: 09/184,898

(22) Filed: Nov. 3, 1998

(51) Int. Cl.[7] ..... H01R 13/627
(52) U.S. Cl. ..... 439/362
(58) Field of Search ..... 439/362, 357, 439/365, 378

(56) References Cited

U.S. PATENT DOCUMENTS 4,935,847 * 6/1990 Welsh ..... 361/415
5,426,567 * 6/1995 Opeka ..... 439/362

OTHER PUBLICATIONS

"Hybricon launches high–performance VME 64–bit extension backplanes," CMP net.

* cited by examiner

*Primary Examiner*—Brian Sircus
*Assistant Examiner*—J. F. Duverne
(74) *Attorney, Agent, or Firm*—David J. Powsner; Nutter, McClennen & Fish LLP

(57) ABSTRACT

A multi-connector system electrically couples circuit components, such as printed circuit boards, daughtercards, integrated circuits and the like. The system includes two or more electrical connector sockets, each of which is physically coupled to a first supporting member, e.g., a rigid bar or plate. Two or more electrical connector plugs are also provided, each of which is physically coupled to a second supporting member, again, for example, a rigid bar or plate. The connector plugs and sockets can be, for example, of the VME64 160-pin variety or of any other variety and style known in the art. A jacking element, which is physically coupled with both the first and second supporting members, can be manipulated to bring them together and/or to separate them and, thereby, to couple and/or uncouple the sockets from their respective plugs.

30 Claims, 8 Drawing Sheets

SYSTEM FOR HIGH-BANDWIDTH ELECTRICAL COUPLING

BACKGROUND OF THE INVENTION

The invention pertains to electrical connectors and, more particularly, to systems for facilitating mating and detachment of electrical connectors of the types typically used in computing, networking, and other high bandwidth applications.

As the processing power, storage capacity and throughput of digital data processing devices increases, greater demands are placed on designers to provide high bandwidth digital signal pathways, or buses. The buses of early personal computers, for example, typically permitted the transfer of only eight bits of information at a time. Though small by today's standards, these buses were more than adequate to carry the addressing and data signals used by central processing and memory units of the day. In the course of twenty years, buses capable of transferring 32 or 64 bits of information have become de rigeur in workstations and high-end computing systems.

Buses fixed onto a single piece of equipment typically comprise bands of copper or other conducting material etched into layers of a non-conductive substrate. Where the buses carry information between two pieces of equipment, connectors are used. Typically, these comprise a combination of a plug and a socket that mate to provide both electrical and, where necessary, mechanical coupling. A common example is the 25-pin plug used to connect a printer cable to the parallel port socket on the back of a personal computer.

More compact and higher throughput connectors are often used to connect digital data processing printed circuit boards to one another. The VITA Standards Organization, for example, calls for a 160-pin, 5-row connector to couple circuit boards that operate in accord with the VME-64 Extensions Draft Standard 1.1-1997. These connectors are small, measuring approximately 3.5"×0.5", so as not to consume valuable "real estate" on the boards or within their hosts. In switching applications, multiple connectors are typically placed side-by-side, with each coupling a respective bus or bus segment.

The forces required to mate and detach such connectors can be rather large. Insertion of a VME64 160-pin, 5-row connector into a corresponding socket can require forces up to 40 pounds. In addition to the stresses this places on the boards and other circuit components to which the connectors are mounted, it can make multi-connector connections virtually impossible even for those with the strongest of hands.

An object of this invention, accordingly, is to provide improved systems for coupling electrical components.

Another object of the invention is to provide such systems as are adapted for use with pre-existing connectors, including without limitation the aforementioned VME64 160-pin, 5-row connectors.

Yet another object of the invention is to provide such systems as are adapted for use with multi-connector configurations.

Still another object of the invention is to provide such systems as consume little real estate on the boards or other electrical components in or on which they are used.

Yet still another object of the invention is to provide such systems as can be used with "interposers" or other such intermediate circuit components.

SUMMARY OF THE INVENTION

The foregoing are among the objects attained by the invention which provides, in one aspect, a multi-connector system for electrically coupling circuit components, such as printed circuit boards, daughtercards, integrated circuits and the like. The system includes two or more electrical connector sockets, each of which is physically coupled to a first supporting member, e.g., a rigid bar or plate. Two or more electrical connector plugs are also provided, each of which is physically coupled to a second supporting member, again, for example, a rigid bar or plate. The connector plugs and sockets can be, for example, of the VME64 160-pin, 5-row variety or of any other variety and style known in the art. A jacking element, which is physically coupled with both the first and second supporting members, can be manipulated to bring them together and/or to separate them and, thereby, to mate and/or detach the sockets from their respective plugs.

A further aspect of the invention provides a multi-connector system as described above in which the jacking element is a threaded member, e.g., a screw or bolt. In a system according to this aspect, the jacking element is selectively rotated to bring together or separate the supporting members.

Still further aspects of the invention provide a multi-connector system as described above in which the connectors (i.e., the sockets and plugs) are affixed to the respective supporting members, e.g., by screws. A plurality of jacking elements, moreover, can be provided which are coupled to the supporting members about the periphery of the connectors.

In still further aspects, the invention provides a system as described above in which the first supporting member comprises a unitary bar-like member, a "jacking bar," that is coupled to a plurality of connector sockets, e.g., of the VME64 160-pin, 5-row variety. Such a bar, according to further aspects of the invention, can have a plurality of flanges that facilitate physically coupling between the bar and the sockets. Thus, for example, one or more such flanges can be arranged to receive screws that affix the bar to the socket while others can be arranged to be disposed within the periphery of the socket housings, e.g., to prevent motion thereof.

In a related aspect of the invention, the invention provides a system as described above in which the jacking bar is affixed to each connector socket so as to reside within an outer perimeter defining an area the socket occupies on the circuit component, i.e., to reside within the socket's "footprint." To this end, the flanges can be arranged to complement the surface contour of the sockets, e.g., so that the bar can be fitted over (and not around) ends of the sockets.

According to further aspects of the invention, the second supporting member can comprise an intermediate circuit element, e.g., an interposer card or other element that facilitates or alters an electrical and/or mechanical interface to the connector plugs.

Still further aspects of the invention provide a kit comprising at least one of a first and second supporting member as described above. The kit can further include a jacking element, e.g., a screw, for use with the supporting members, as well as connectors plugs and sockets.

These and other aspects of the invention are evident in the drawings and in the text that follows.

BRIEF DESCRIPTION OF THE DRAWINGS

A further understanding of the invention may be attained by reference to the drawings, in which.

DETAILED DESCRIPTION OF THE ILLUSTRATED EMBODIMENT

Figure 1A:
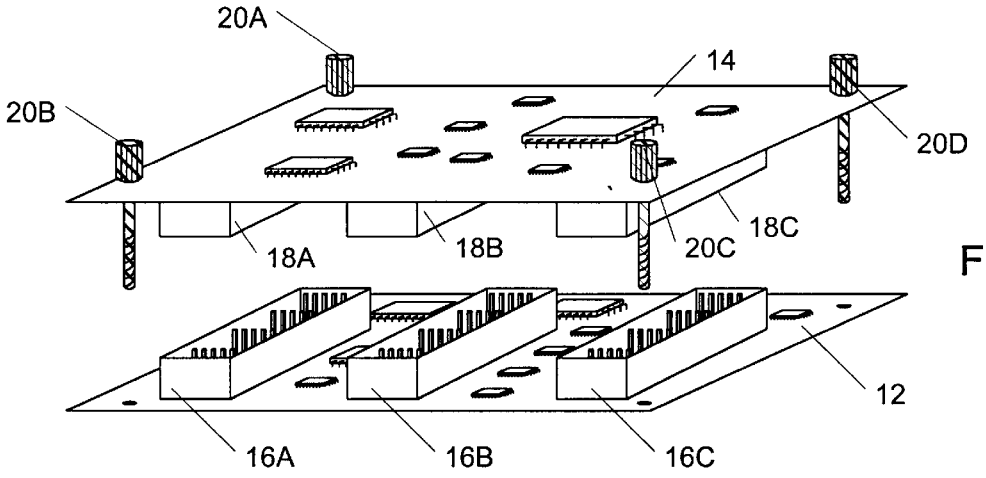
FIGS. 1A–1C depict a multiconnector system according to the invention, wherein circuit components to be connected serve as support members for the connectors.

FIG. 1A depicts a multi-connector system 10 for electrically coupling circuit components 12, 14, which may comprise printed circuit boards, daughter cards, integrated circuits or other circuit components which are to be placed in electrical contact with one another. Plural connector sockets 16A, 16B, 16C are mounted on a rigid supporting member, here, shown as circuit board 12 itself. Corresponding connector plugs 18A–18C are likewise mounted on a rigid supporting member. In the illustrated embodiment, this is circuit board 14.

Connector sockets 16A–16C and connector plugs 18A–18C comprise the female and male halves of conventional electrical connectors of the type known in the art. Though corresponding sockets and plugs are preferably of the same type, i.e., so that they will properly mate, not all connectors need not be of the same type.

The invention is particularly adapted to facilitate coupling multiple connectors for which the cumulative insertion and detachment forces are large, e.g., VME64 160-pin, 5-row connectors. A more detailed depiction of this particular type of connector socket and, particularly, of its external housing, is presented in FIG. 3, which shows socket array 16' on board 12'.

Rotatable threaded elements, e.g., knurled-headed bolts or screws 20A–20D, are rotatably mounted in one of the supporting members, here, board 14. These can be mated with nuts or threaded holes in the other supporting member 12 so that, when the bolts 20A–20D are turned, the supporting members (and, therefore, the plugs and sockets) are brought together or separated, depending on the direction of manipulation.

Elements 20A–20D are referred to as "jack" screws, though jacking elements other than screws may be used instead. These include levers, cams and other elements that can be coupled to the supporting members in order to bring together and/or separate the supporting members and, thereby, to couple or decouple the sockets 16A–16C and their corresponding plugs 18A–18C.

In the illustrated embodiment, jack screws 20A–20D are disposed about the periphery of the connectors, though other locations on the supporting members may also be suitable. Though multiple jacking screws are preferred, a single screw or other jacking element may be suitable if, for example, it can be manipulated by the user so as to couple and decouple the connectors.

Figure 1B:
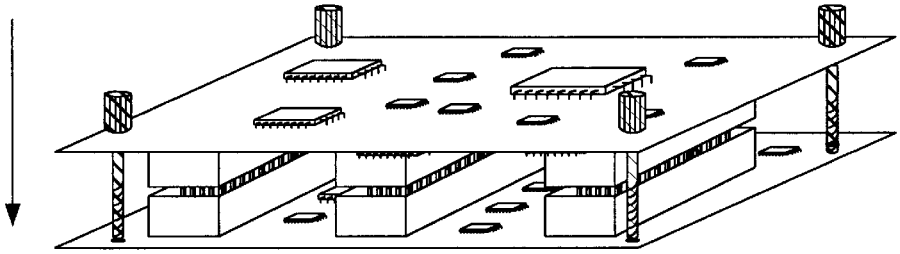
Figure 1C:
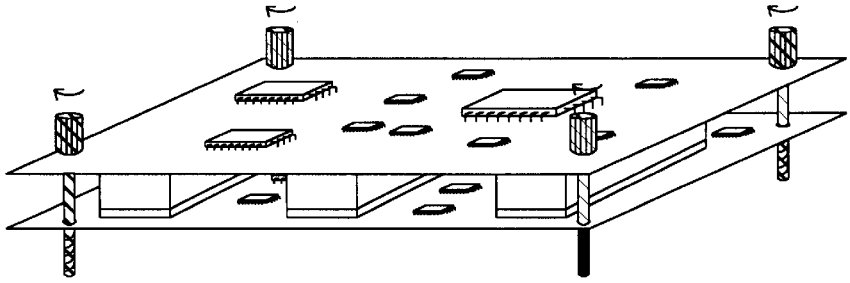

Operation of the system 10 is illustrated in FIG. 1B and 1C. The former illustrates the circuit components 12, 14 being brought in sufficient vicinity that the jack screws can be rotatably coupled to both of those components. FIG. 1C illustrates the effect of manipulating the jack screws. By successively tightening (or loosening) them, the support members are brought together (or pulled apart) so as to progressively bring the sockets 16A–16C and plugs 18A–18C together (or apart).

The supporting members need not comprise the circuit components (i.e., circuit boards 12, 14) which are to be placed into electrical coupling with one another. Instead, they may comprise separate elements, such bars, plates, or other rigid members suitable for supporting the sockets 16A–16C and plugs 18A–18C as they are mated and detached from one another.

Figure 2A:
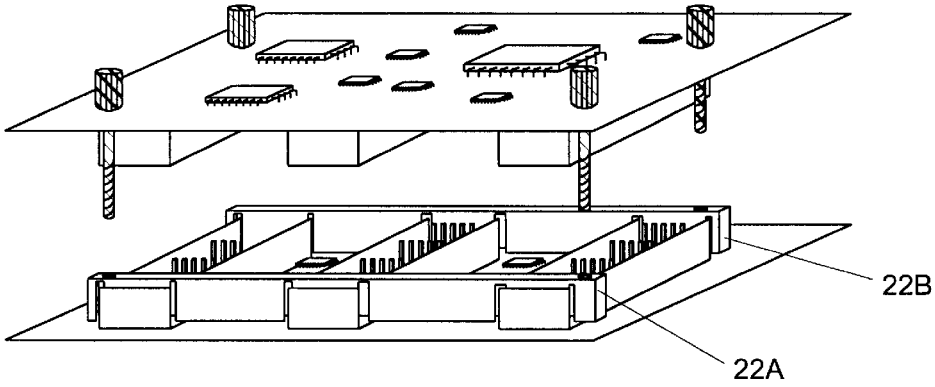
FIGS. 2A–2C depict a multiconnector system according to the invention including a jacking bar to support the connector sockets.
Figure 2B:
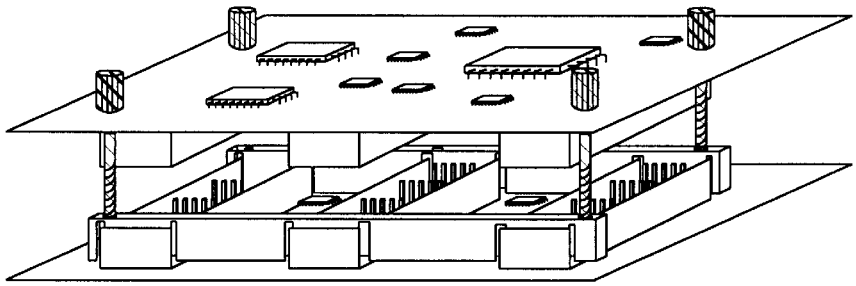
Figure 2C:
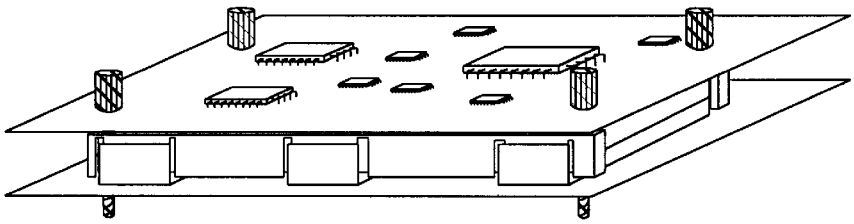

To this end, FIG. 2A illustrates a preferred embodiment in which bars 22A, 22B, or "jack bars," are used as support members for the connector sockets 16A–16C. The jack bars can be screw-mounted or otherwise directly affixed to the sockets 16A–16C, or they can be indirectly affixed, e.g., the bars and the sockets can be screw-mounted or affixed to the board 12 As shown in FIGS. 2B and 2C, the jack bars 22A, 22B, in combination with the jack screws, facilitate bringing the plugs and sockets together (or pulling them apart).

Figure 3:
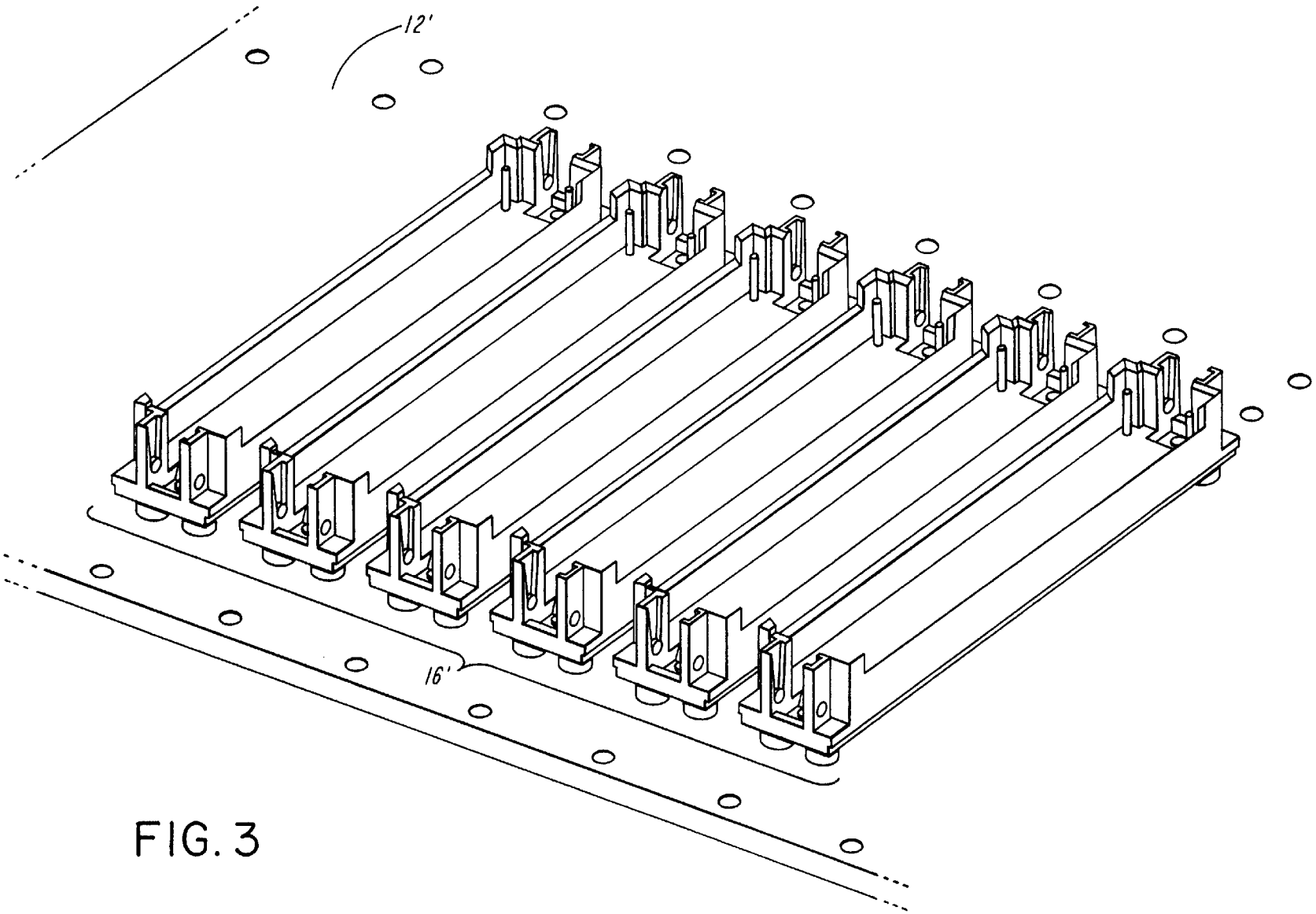
FIG. 3 depicts a socket array of the type with which the invention is used.
Figure 4A:
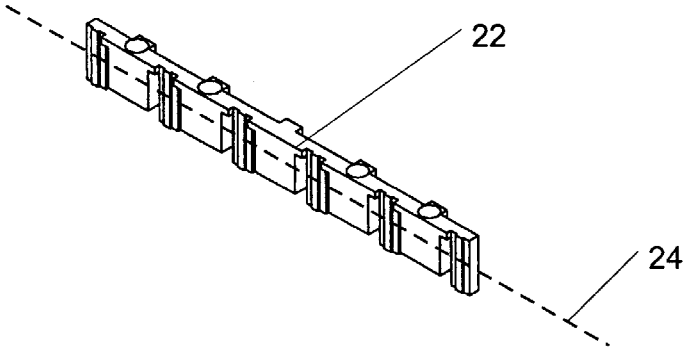
FIGS. 4A–4C depict a jacking bar according to the invention for use with a socket array of the type shown in FIG. 3.
Figure 4B:
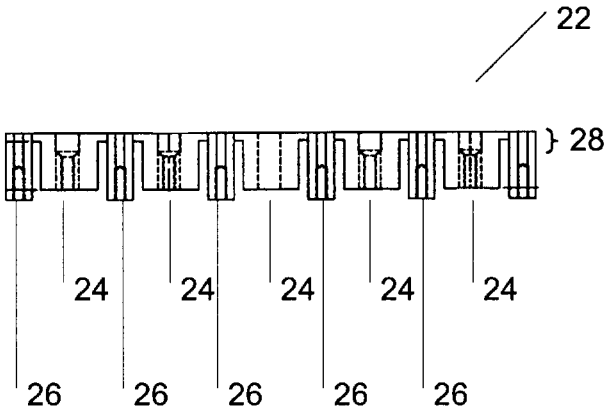
Figure 4C:
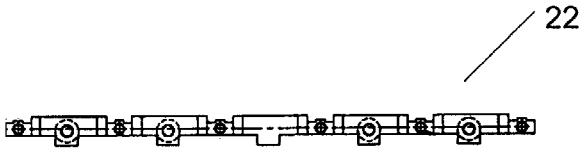

FIG. 4A is a perspective view of a preferred jack bar 22 for use with VME64 160-pin, 5-row connectors of the type shown in FIG. 3. FIGS. 4B and 4C are front and top views of that same jack bar 22. The jack bar 22 is preferably of unitary metallic construction, i.e., formed from a single bar of metal, though any other suitable material sufficient to support the sockets 16A–16C (as well as their associated mating and detachment forces) as they are mated and detached from one another will do.

The jack bar 22 is generally elongate, being sized along longitudinal axis 24 sufficiently to support sockets 16A–16C during mating and detachment. As shown in the drawings, it has a plurality of flanges 24, 26 emanating from body 28 that facilitate physical coupling between the bar and the socket connector. Flanges 24 can be arranged for disposal within the bodies of sockets 16A–16C, while flanges 26 can be arranged to receive screws that affix the bar 22 to the socket and/or board 12. In addition to supporting the sockets during mating and detachment operations, flanges 24 and/or flanges 26 minimize motion of the sockets 16A–16C.

Figure 5:
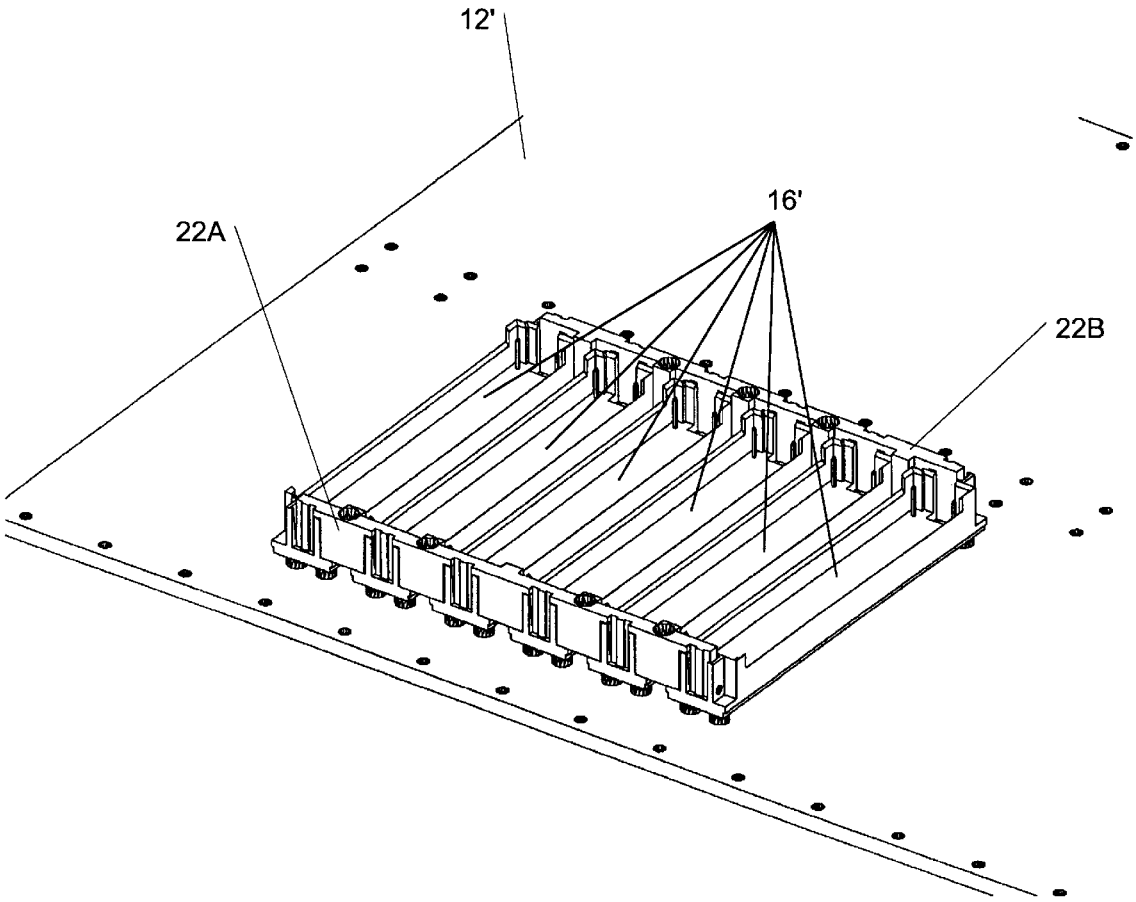
FIG. 5 depicts a socket array of FIG. 3 in combination with a jacking bar of FIG. 4.

FIG. 5 depicts the use of jack bars 22A, 22B of the type shown in FIGS. 4A–4C to hold to circuit board 12' a socket array 16' of the type shown in FIG. 3. As evident in FIG. 5, the bars are affixed to each connector socket so as to reside within an outer perimeter defining an area the socket occupies on the board 12, i.e., to reside within the socket's "footprint." In this regard, it will be appreciated that flanges 24, 26 are arranged to complement portions of a surface contour of the sockets, e.g., so that the bar can be fitted over ends of the sockets and not to extend substantially far over those ends.

Figure 6:
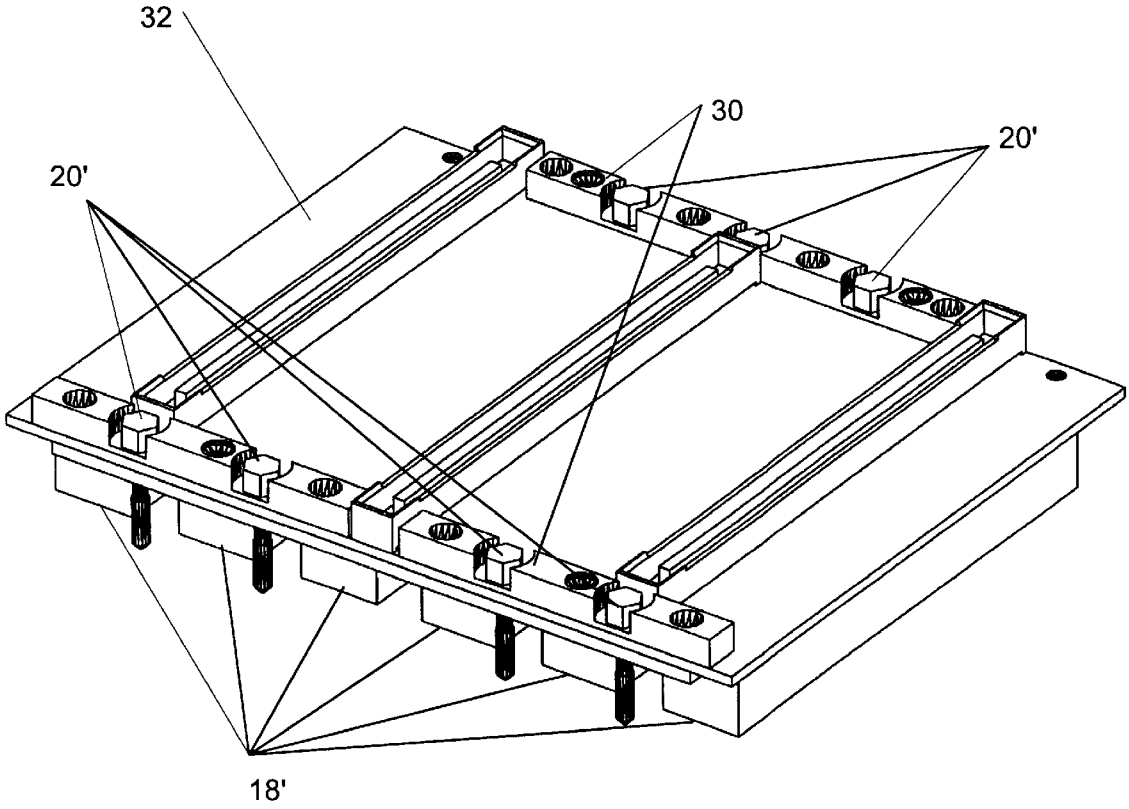
FIG. 6 depicts an intermediate circuit assembly, e.g., an interposer, used as a support member for connector plugs.

Referring to FIG. 6, there is shown connector plug array 18' disposed on an intermediary circuit, e.g., an interposer card 32, that facilitates placing circuit board 14 into electrical coupling with the connector plugs. Interposers, which are known the art, are circuit elements used to facilitate or modify an electrical and/or mechanical interface to parts, such as VME64 160-pin, 5-row connectors, e.g., that have high pin densities and ball grid array connections. As further shown in FIG. 6, bar-like member 30 is used in connection with card 21 to support plug array 18', e.g., during mating and detachment from socket array 16'. Jack screws 20', which are rotatably coupled to member 30 facilitate such mating and detachment in the manner discussed above.

Figure 7:
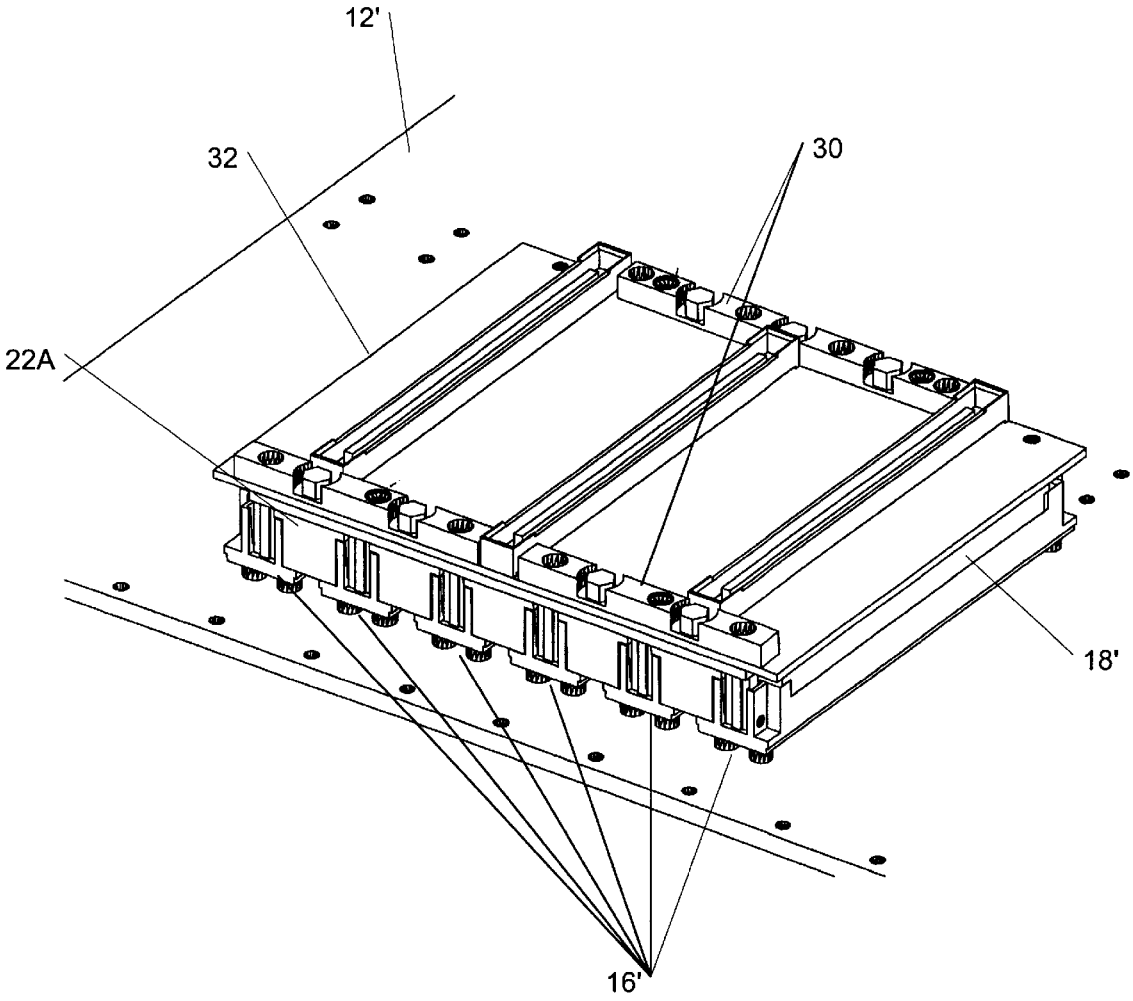
FIG. 7 depicts the intermediate circuit assembly of FIG. 6 in combination with the assembly of FIG. 5.
Figure 8:
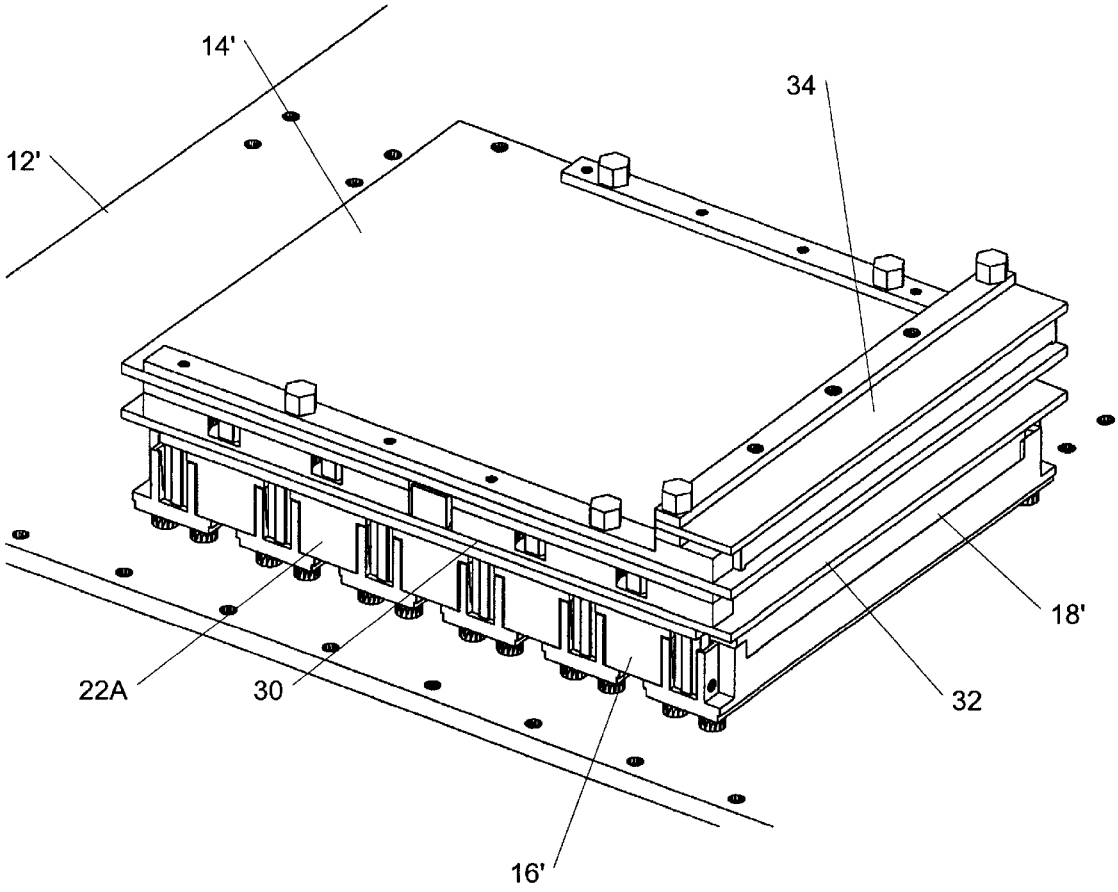
FIG. 8 depicts a circuit assembly utilizing a multiconnector system according to the invention.

FIG. 7 shows an assembly including the interposer 32 (including plug array 18', support member 30 and jack screws 20') with circuit board 22' (including jack bars 22A, 22B and socket array 16'). FIG. 8 shows the addition of circuit board 14' to this assembly. Also shown in FIG. 8 is a cable flex card 34 which can be used to transfers signals to and from the board 14', e.g., and host processing equipment (not shown).

Described herein is multi-connector system meeting the objects set forth above. Those skilled in the art will appreciate that the illustrated embodiment is an example of the invention and that other apparatus incorporating changes thereto fall within the scope of the invention. Thus, for example, the support members and jacking members can be used with a range of connectors, in addition to the illustrated VME64 160-pin, 5-row connectors. And, the illustrated element 22A, can be used to support connector plugs, as well as or instead of sockets. In view of these and other modifications within the ken of those skilled in the art,

What I claim is:

1. A multi-connector system for electrically coupling circuit components, the system comprising, A. a plurality of connector sockets, each of which is physically coupled to a first supporting member, B. a plurality of connector plugs, each of which is physically coupled to a second supporting member, the connector sockets and connector plugs collective referred to as "connectors", C. a jacking element, which is physically coupled with both the first and second supporting members, D. the jacking element being arranged, upon manipulation, to at least one of (i) bring together the supporting members and, thereby, mate the sockets to respective ones of the plugs, and (ii) separate the supporting members and, thereby, detach the sockets from respective ones of the plugs, E. a first one of the supporting members plurality flanges emanating therefrom, at least some of the flanges being arranged for disposal within bodies of the plurality connectors with which that supporting member is physically coupled.

2. A system according to claim 1, wherein the second supporting member comprises a circuit component.

3. A system according to claim 2, wherein the second supporting member comprises any of a printed circuit board, a daughtercards, and an integrated circuit.

4. A system according to claim 1, wherein the jacking element is a threaded member arranged for coupling to the first and second supporting members.

5. A system according to claim 4, wherein upon rotation the jacking element at least one of brings together and separates the supporting members.

6. A system according to claim 5, wherein the jacking element is any of a screw and a bolt.

7. A system according to claim 5, comprising a plurality of jacking elements disposed about the periphery of any of the supporting member, the connector plugs and the connector sockets.

8. A system according to claim 1, wherein at least the first supporting member is rigid.

9. A system according to claim 1, wherein at least one flange f toe bar-like member is arranged to receive screws that affix the bar-like member to at least one socket.

10. A system according to claim 1, wherein at least one flange is arranged to minimize lateral motion of at least one Socket.

11. A system according to claim 1, wherein the second supporting member comprises an interface circuit element.

12. A system according to claim 11, wherein the interface circuit element comprises an interposer 15.

13. A multi-connector system for electrically coupling circuit components, the system comprising A. a plurality of connector sockets, each of which is physically coupled to a first supporting member, the first supporting member including any of circuit component and a bar-like supporting member, B. a plurality of connector plugs, each of which is physically coupled to a second supporting member, the second supporting member comprising any of a circuit component and an interface component, C. a jacking element, which is physically coupled with both the first and second supporting members, the jacking element comprising any of a screw and a bolt that is rotatably coupled to the first and second supporting members, the connector sockets and connector plugs collectively referred to as "connectors", D. the jacking element being arranged, upon rotation to at least one of (i) bring together the supporting members and, thereby, mate the sockets to respectives ones of the plugs, and (ii) separate the supporting members and, thereby, detach the sockets from respective ones of the plugs, E. a first one of the supporting members comprises a bar-like member having a body and a plurality flanges emanating therefrom, at least, some of the flanges being arranged for distposal within bodies of the plurality connectors with which that supporting member is physically coupled.

14. A system according to any of claim 1 and 15 wherein the connector sockets and connector plugs are VME64, 160-pin, 5-row connectors.

15. A multi-connector system for electrically coupling circuit components, the system comprising, A. a plurality of connector sockets, each of which is physically coupled to a first supporting member, B. a plurality of connector plugs, each of which is physically coupled to a second supporting member, the connector sockets and connector plugs collectively referred to as connectors C. a jacking element, which is physically coupled with both the first and second supporting members, D. the jacking element being arranged, upon manipulation, to at least one of (i) bring together the supporting members and, thereby, mate the sockets to respective ones of the plugs, and (ii) separate the supporting members and, thereby, detach the sockets from respective ones of the plugs, E. a first one of the supporting members comprises an elongate bar-like member having a body and a plurality flanges emanating therefrom, at least some of the flanges being arranged for disposal within bodies of the plurality connectors with which that supporting member is physically coupled, at least some others of the flanges facilitating affixing the bar-like member to any of a circuit board or to at least one connector with which the bar-like member is physically coupled.

16. A system according to any of claim 1 and 15, wherein th e bar-like member is affixed to the connectors with which it is physically coupled so as to reside within an outer perimeter defining an area or footprint those connectors occupy on a board on which the connectors are mounted.

17. A multi-connector system for electrically coupling circuit components, the system comprising, A. a plurality of connector sockets, each of which is physically coupled to a first supporting member, B. a plurality of connector plugs, each of which is physically coupled to a second supporting member, the connector sockets and connector plugs being collectively referred to as "connectors", C. a jacking element, which is physically coupled with both the first and second supporting members, D. the jacking element being arranged, upon manipulation, to at least one of (i) bring together the supporting members and, thereby, mate the sockets to respective ones of the plugs, and (ii) separate the supporting members and, thereby, detach the sockets from respective ones of the plugs, E. at least one of the supporting members comprising a bar-like member that is affixed to the connectors with which the bar-like member is physically coupled so as to reside within an outer perimeter defining an area or footprint the connectors occupy on a board on which the connectors are mounted.

18. A system according to claim 17, wherein the second supporting member comprises a circuit component.

19. A system according to claim 18, wherein the second supporting member comprises any of a printed circuit board, a daughtercards, and an integrated circuit.

20. A system according to claim 17, wherein the jacking element is a threaded member arranged for coupling to the first and second supporting members.

21. A system according to claim 20, wherein upon rotation the jacking element at least one of brings together and separates the supporting members.

22. A system according to claim 21, wherein the jacking element is any of a screw and a bolt.

23. A system according to claim 21, comprising a plurality of jacking elements disposed about the periphery of any of the supporting member, the connector plugs and the connector sockets.

24. A system according to claim 17, wherein at least the first supporting member is rigid.

25. A system according to claim 17, wherein at least one flange of the bar-like member is arranged to receive screws that affix the bar-like member to at least one socket.

26. A system according to claim 17, wherein at least one flange is arranged to minimize lateral motion of at least one socket.

27. A system according to claim 17, wherein the second supporting member comprises an interface circuit element.

28. A system according to claim 27, wherein the interface circuit element comprises an interposer.

29. A multi-connector system for electrically coupling circuit components, the system comprising A. a plurality of connector sockets, each of which is physically coupled to a first supporting member, the first supporting member including any of circuit component and a bar-like supporting member, B. a plurality of connector plugs, each of which is physically coupled to a second supporting member, the second supporting member comprising any of a circuit component and an interface component, C. a jacking element, which is physically coupled with both the first and second supporting members, the jacking element comprising any of a screw and a bolt that is rotatably coupled to the first and second supporting members, the connector sockets and connector plugs collectively referred to as "connectors", D. the jacking element being arranged, upon rotation to at least one of (i) bring together the supporting members and, thereby, mate the sockets to respectives ones of the plugs, and (ii) separate the supporting members and, thereby, detach the sockets from respective ones of the plugs, E. at least one of the supporting members comprising a bar-like member that is affixed co the connectors with which the bar-like member is physically coupled so as to reside within an outer perimeter defining an area or footprint the connectors occupy on a board on which the connectors are mounted.

30. A system according to any of claim 17 and 29, wherein the connector sockets and connector plugs are VME64, 160-pin, 5-row connectors.

* * * * *

UNITED STATES PATENT AND TRADEMARK OFFICE

CERTIFICATE OF CORRECTION

PATENT NO. : 6,227,897 B1
DATED : May 8, 2001
INVENTOR(S) : D'Agostino

It is certified that error appears in the above-identified patent and that said Letters Patent is hereby corrected as shown below:

Column 5,
Line 27, please delete "collective"; and insert therefor -- collectively --.
Line 38, after "supporting members" please insert -- comprises a bar-like member having a body and a --.
Line 63, please delete "f toe"; and insert therefor -- of the --.
Line 67, please delete "Socket"; and insert therefor -- socket --.

Column 6,
Line 4, after "comprises an interposer" please delete "15".
Line 30, after "at least" please delete ",".
Line 31, please delete "distposal"; and insert therefor -- disposal --.
Line 34, please delete "15"; and insert therefor -- 13 --.
Line 44, please delete "connectors"; and insert therefor -- "connectors," --.
Line 65, please delete "th e"; and insert therefor -- the --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*